US011773867B1

(12) United States Patent
Huang

(10) Patent No.: US 11,773,867 B1
(45) Date of Patent: Oct. 3, 2023

(54) FAN FRAME

(71) Applicant: Huizhou Sancreate Technology Co., LTD, Guangdong (CN)

(72) Inventor: Helen Huang, Ruian (CN)

(73) Assignee: Huizhou Sancreate Technology Co., LTD, Huizhou (CN)

( * ) Notice: Subject to any disclaimer, the term of this patent is extended or adjusted under 35 U.S.C. 154(b) by 0 days.

(21) Appl. No.: 18/092,943

(22) Filed: Jan. 4, 2023

(51) Int. Cl.

| | |
|---|---|
| ***F01D 1/00*** | (2006.01) |
| ***F04D 29/40*** | (2006.01) |
| ***F04D 25/08*** | (2006.01) |
| ***H01R 13/405*** | (2006.01) |

(52) U.S. Cl.
CPC ..... *F04D 29/40* (2013.01); *F04D 25/08* (2013.01); *H01R 13/405* (2013.01)

(58) Field of Classification Search
CPC .... H05K 7/20172; H05K 1/117; H02K 5/225; H01R 12/714
USPC ..... 415/182.1
See application file for complete search history.

(56) References Cited

U.S. PATENT DOCUMENTS

| | | | | |
|---|---|---|---|---|
| 2019/0232754 | A1* | 8/2019 | Horng | F04D 25/0606 |
| 2021/0018009 | A1* | 1/2021 | Hsieh | F04D 25/0693 |
| 2023/0039041 | A1* | 2/2023 | Katsuki | H02K 11/33 |
| 2023/0061299 | A1* | 3/2023 | Sun | H01R 13/50 |
| 2023/0124080 | A1* | 4/2023 | Lewis | H05K 7/20736 361/695 |

* cited by examiner

*Primary Examiner* — Long T Tran
*Assistant Examiner* — James J Kim

(57) ABSTRACT

Disclosed is a fan frame. The fan frame includes a frame body, a PIN body embedded in the frame body, and an outlet body connected to one end of the PIN body; and an accommodation cavity is provided in the frame body, the PIN body is embedded in the accommodation cavity, and the other end of the PIN body is connected to a circuit board. By designing the fan frame, automatic assembly on the circuit board is facilitated, connection to a test fixture is convenient, manually connecting the wires one by one for tests is avoided, and automatic tests, and simple, convenient and quick operation are achieved.

9 Claims, 6 Drawing Sheets

FAN FRAME

TECHNICAL FIELD

The present invention belongs to the technical field of fan frames, and particularly relates to the fan frame.

BACKGROUND ART

For most fan frame assemblies on the market in the prior art, wires are directly welded on a circuit board. The wires are difficult to fix in shape due to their flexible conductors, are not easy to automatically assembly on the circuit board accordingly, and are prone to welding dislocation and sealing-off under stress. Apart from that, conventional testing of fan products often requires manually wire connection, which is complicated and difficult to operate and makes it hard to guarantee the production quality.

SUMMARY

According to an example of the present application, a fan frame is provided, by designing the fan frame, the problem that flexible wires are difficult to weld to a circuit board is solved, thus facilitating automatic assembly on the circuit board, improving welding accuracy, effectively preventing the phenomenon of under-stress sealing-off, improving a welding success rate and effectively ensuring production quality. And, the wires are convenient to connect to a test fixture, thus avoiding testing by manually connecting the wires one by one, and achieving automatic testing, and simple, convenient and quick operation.

A technical solution provided by the example of the present application is as follows:

A fan frame includes a frame body, a PIN body embedded in the frame body, and an outlet body connected to one end of the PIN body; an accommodation cavity is provided in the frame body, and the PIN body is embedded in the accommodation cavity, and the other end of the PIN body is connected to a circuit board; and the PIN includes PIN needles arranged in an array and a needle case sleeving the PIN needles. The needle case may be a plastic needle case, or the needle case can be formed by overmolding on the PIN needles, or the frame body may be formed through overmolding by putting the PIN needles into corresponding molds.

According to the present invention, the PIN needle is a rigid PIN needle, and therefore is easy to automatically assembly on the circuit board, thereby effectively improving welding accuracy and the welding success rate, further effectively preventing sealing-off caused by external force pulling, ensuring connection stability and effectively ensuring production quality. And the PIN body is embedded in the frame body by arranging the accommodation cavity, such that a structure is designed compact, and a space utilization rate is effectively improved. And that other end of the PIN needle is connected to the outlet body, such that assembly may be flexibly performed according to the requirements of lengths of different wires, and the fan frame is guaranteed to have a large share range and high flexibility is achieved; and the other end of the PIN needle may also be connected to a test fixture, such that automatic testing is implemented, and the operation is convenient and quick.

Further, the number of the PIN needles is a multiple of 2. Through the arrangement, the number of PIN needles may be flexibly arranged according to actual production, so as to satisfy diversity and achieve high flexibility. The number of PIN needles may be 2 or 4 or 6 or more needles.

Further, the PIN needle is a square PIN needle or a round PIN needle. Through the arrangement, square PIN needles or round PIN needles may be flexibly arranged according to the demand of convenient connection, so as to facilitate operation and production, and achieve high flexibility.

Further, the needle case is provided with first holes corresponding to the PIN needles. Through the arrangement, the PIN needle is inserted into the first hole, thus effectively ensuring stability of the PIN needle, desirable insulation effects for the PIN needle and connection quality.

Further, the outlet body includes a terminal connected to the PIN a plastic housing sleeving the terminal and embedded in the accommodation cavity, and a wire connected to the other end of the terminal pin. Through the arrangement, the plastic housing sleeves the terminal and is connected to the PIN needle, thus effectively improving connection stability and guaranteeing a desirable insulation effect. In addition, the outlet body is connected to the PIN needle, such that disconnection is facilitated, and the fan frame may satisfy the requirement for sharing from different wire lengths.

Further, the plastic housing includes a housing body, a first stop block arranged at an upper end of the housing body, and first fixation blocks arranged at two sides of the housing body, and the frame body is internally provided with a first clamping recess clamping the first stop block.

Further, the housing body is provided with a second hole corresponding to the terminal, and the first fixation block includes a first clamping block perpendicular to a plane where the first stop block is located, and a second clamping block arranged symmetrically with respect to a middle line of one side of the first clamping block, the second clamping block is arranged corresponding to the terminal.

Further, one side, close to the first fixation block, of the terminal is provided with a third stop block, the terminal penetrates a second hole to be connected to the PIN needle, and the third stop block is fixedly connected to a second clamping block.

Further, an upper end of the first fixation block and a front of the first fixation block are provided with second stop blocks, and a second clamping recess and a third clamping recess which clamp the second stop blocks are provided in the frame body.

A vertical section of the first stop block is a right triangle. One side of the first stop block is provided with an inclined plane, and one side, opposite the inclined plane, of the first stop block is a clamping surface perpendicular to a horizontal plane. The arrangement of the inclined plane facilitates easy and quick clamping between two objects. The arrangement of the clamping surface ensures clamping stability of the two objects. The inclined plane has an angle of 15-30 degrees.

Through the arrangement of the outlet body, fixing of the plastic housing on the frame body is implemented by clamping and fixing the first stop block of the plastic housing with the first clamping recess of the frame body. Then, the terminal is inserted into the plastic housing, and the second clamping block of the first fixation block is clamped by the third stop block of the terminal, one second clamping block is clamped by each terminal accordingly, such that the plastic housing sleeves the terminal. In addition, the second stop blocks at the upper end of the first fixation block and the front of the first fixation block are clamped in the second clamping recess and the third clamping recess, such that after the outlet body is connected to the PIN body, the outlet body is prevented from shaking on the frame body, the connection stability between the outlet body and the frame body is ensured, sealing-off is prevented, and reverse insertion is prevented.

The present invention has the following beneficial effects:

By designing the fan frame, the problem that flexible wires are difficult to weld to a circuit board is solved, thus facilitating automatic assembly on the circuit board, improving welding accuracy, effectively preventing the phenomenon of under-stress sealing-off, improving a welding success rate and effectively ensuring production quality. And, the wires are convenient to connect to a test fixture, thus avoiding testing by manually connecting the wires one by one, and achieving automatic testing, and simple, convenient and quick operation.

Figure 1:
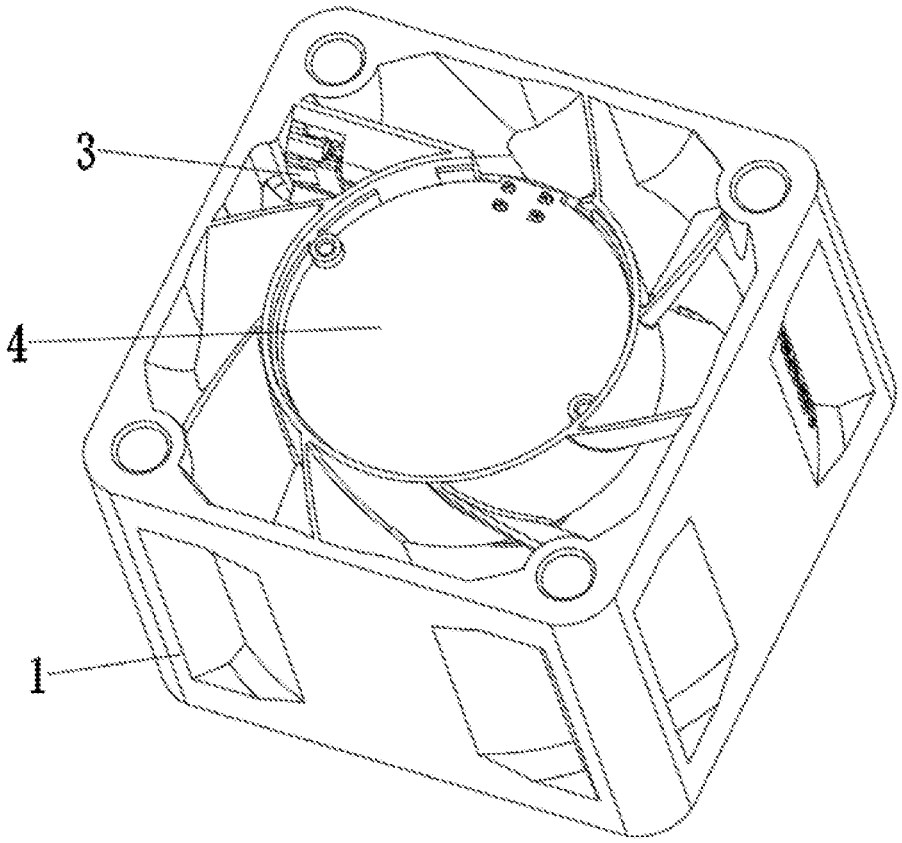
FIG. 1 is a schematic structural diagram of a fan frame according to a first example of the present invention.
Figure 2:
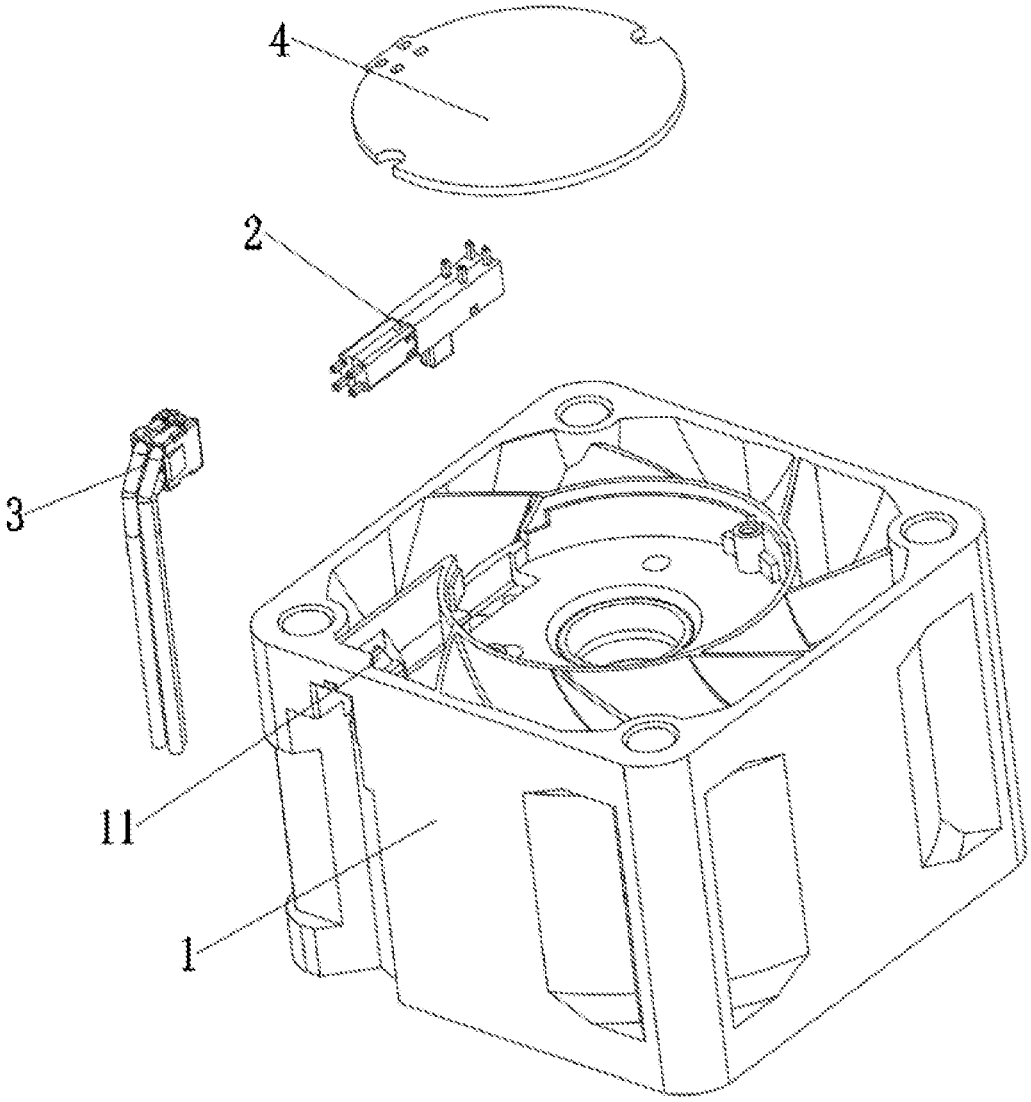
FIG. 2 is an exploded view of the first example of the present invention.
Figure 3:
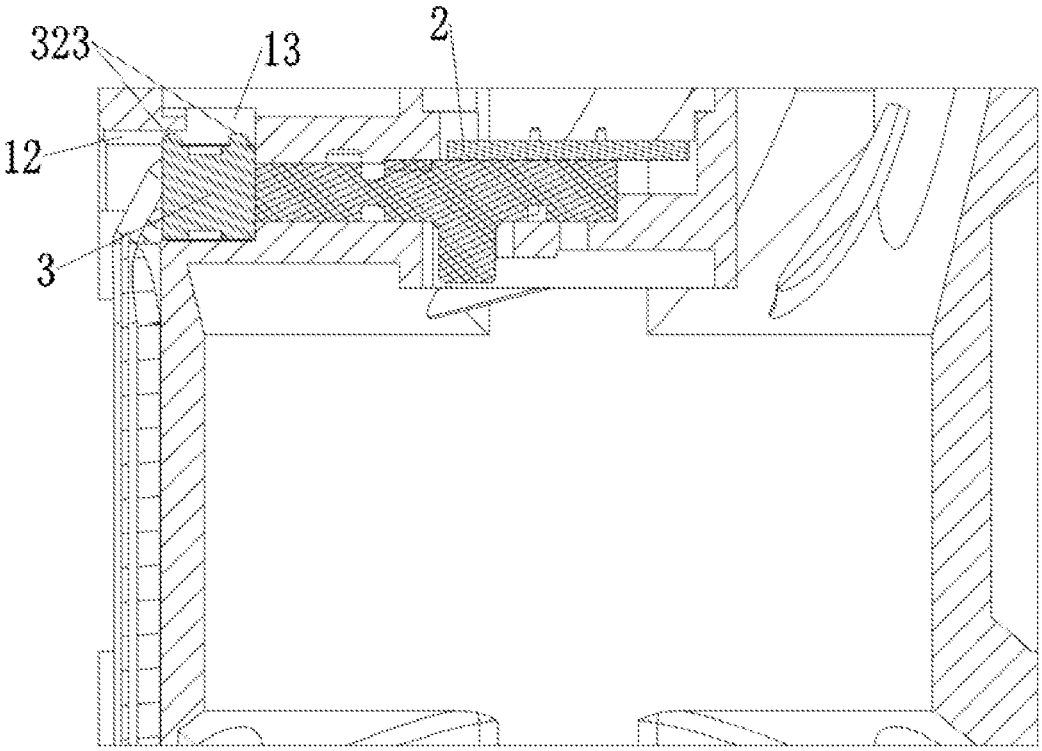
FIG. 3 is a cross-sectional view of the first example of the present invention.
Figure 4:
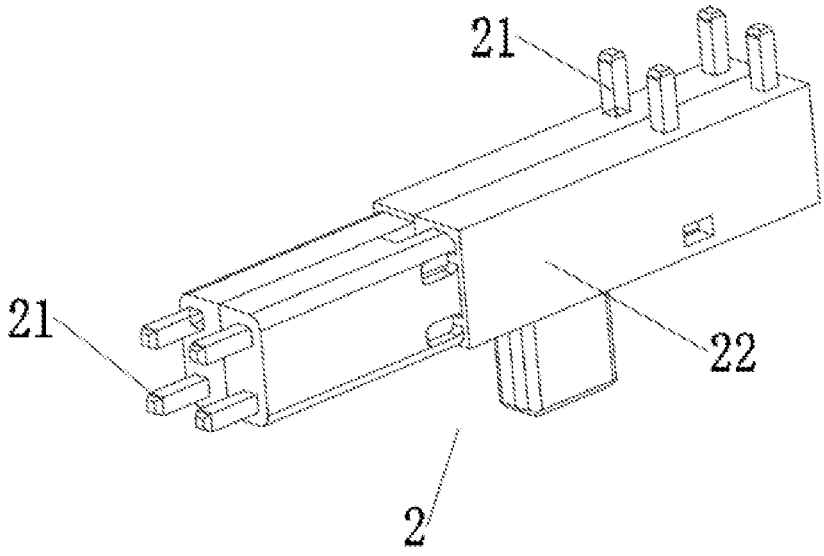
FIG. 4 is a schematic structural diagram of a PIN body according to the first example of the present invention.
Figure 5:
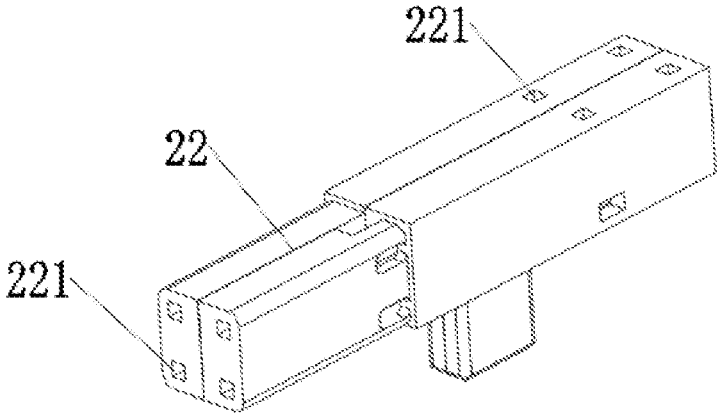
FIG. 5 is a schematic structural diagram of a needle case in the first example of the present invention.
Figure 6:
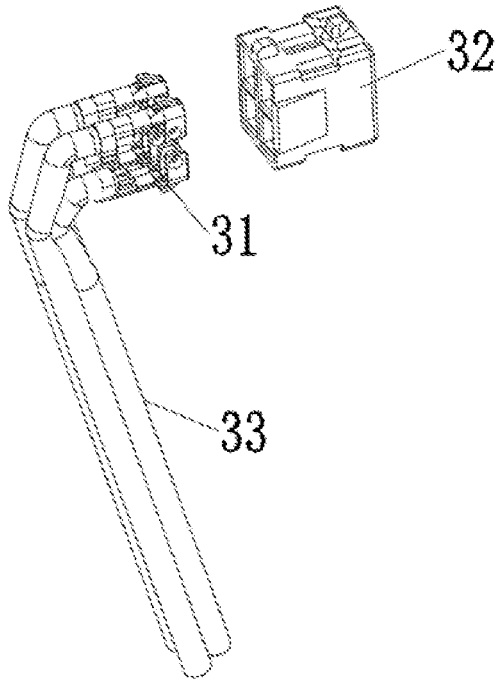
FIG. 6 is an exploded view of an outlet body of the first example of the present invention.
Figure 7:
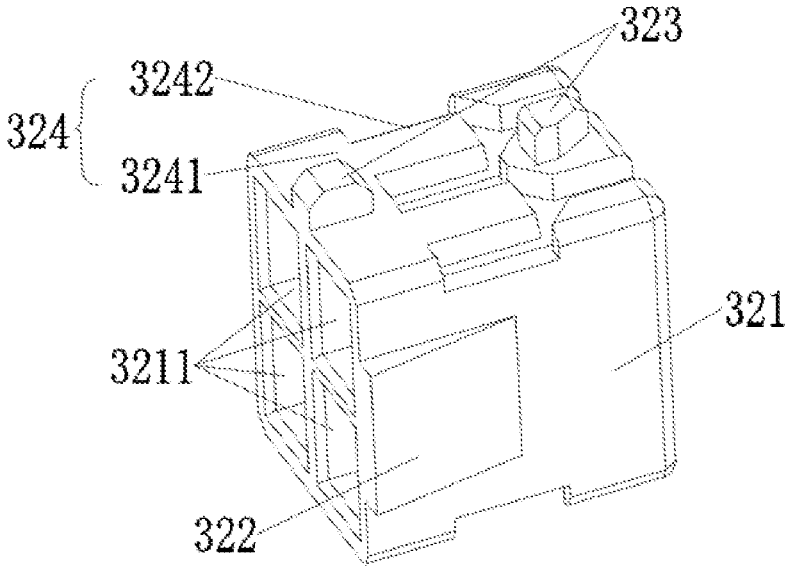
FIG. 7 is a schematic structural diagram of a plastic housing according to the first example of the present invention.
Figure 8:
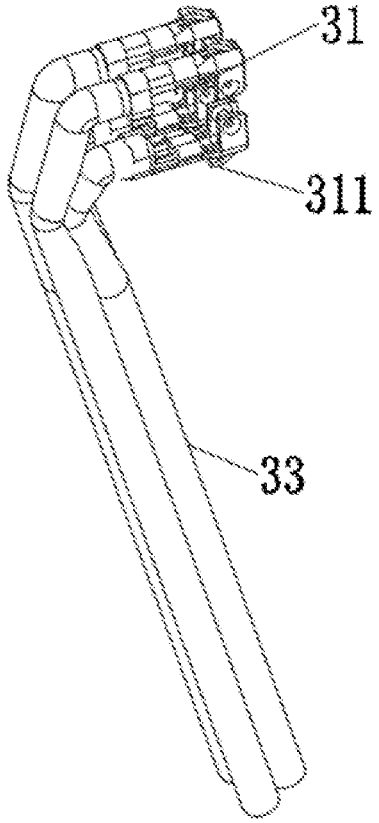
FIG. 8 is a schematic structural diagram of a terminal and a wire according to the first example of the present invention.

Reference numerals: frame 1, first clamping recess 11, second clamping recess 12, and third clamping recess 13; PIN body 2, PIN needle 21, needle case 22, and first hole 221; outlet body 3, terminal 31, third stop block 311, plastic housing 32, housing body 321, second hole 3211, first stop block 322, second stop block 323, first fixation block 324, first clamping block 3241, second clamping block 3242 and wire 33; and circuit board 4.

DETAILED DESCRIPTION OF THE EMBODIMENTS

Technical solutions in examples of the present invention will be clearly and completely described below with reference to accompanying drawings in the examples of the present invention. Apparently, the described examples are merely some rather than all of the examples of the present invention. All other examples derived by a person of ordinary skill in the art based on the examples of the present invention without creative efforts shall fall within the protection scope of the present invention.

Example 1

In order to facilitate the understanding of the present invention by a person of ordinary skill in the art, the present invention will be further described in detail below with reference to specific examples and the accompanying drawings.

As shown in FIGS. 1-8, a first example of the present invention provides a fan frame. The fan frame includes a frame body 1, a PIN body 2 embedded in the frame body 1, and an outlet body 3 connected to one end of the PIN body 2; an accommodation cavity is provided in the frame body 1, and the PIN body 2 is embedded in the accommodation cavity, and the other end of the PIN body 2 is connected to a circuit board 4; and the PIN body 2 includes PIN needles 21 arranged in an array and a needle case 22 sleeving the PIN needles 21. The needle case 22 may be a plastic needle case 22, or the needle case 22 can be formed by overmolding on the PIN needles 21, or the frame body 1 may be formed through overmolding by putting the PIN needles 21 into corresponding molds.

According to the present invention, the PIN needle 21 is a rigid PIN needle 21, and therefore is easy to automatically assembly on the circuit board 4, thereby effectively improving welding accuracy and the welding success rate, further effectively preventing sealing-off caused by external force pulling, ensuring connection stability and effectively ensuring production quality. And the PIN body 2 is embedded in the frame body 1 by arranging the accommodation cavity, such that a structure is designed compact, and a space utilization rate is effectively improved. And that other end of the PIN needle 21 is connected to the outlet body 3, such that assembly may be flexibly performed according to the requirements of lengths of different wires 33, and the fan frame is guaranteed to have a large share range and high flexibility is achieved; and the other end of the PIN needle may also be connected to a test fixture, such that automatic testing is implemented, and the operation is convenient and quick.

In the first example, the number of the PIN needle 21 is 4.

In the first example, the PIN needle 21 is a square PIN needle 21 or a round PIN needle 21. Through the arrangement, square PIN needles 21 or round PIN needles 21 may be flexibly arranged according to the demand of convenient connection, so as to facilitate operation and production, and achieve high flexibility.

In the first example, the needle case 22 is provided with first holes 221 corresponding to the PIN needles 21. Through the arrangement, the PIN needle 21 is inserted into the first hole 221, thus effectively ensuring stability of the PIN needle 21, desirable insulation effects for the PIN needle 21 and connection quality.

In the first example, the outlet body 3 includes a terminal 31 connected to the PIN needle 21, a plastic housing 32 sleeving the terminal 31 and embedded in the accommodation cavity, and a wire 3 connected to the other end of the terminal 31. Through the arrangement, the plastic housing 32 sleeves the terminal 31 and is connected to the PIN needle 21, thus effectively improving connection stability and guaranteeing a desirable insulation effect. In addition, the outlet body 3 is connected to the PIN needle 21, such that disconnection is facilitated, and the fan frame may satisfy the requirement for sharing from lengths of different wires 33.

In the first example, the plastic housing 32 includes a housing body 321, a first stop block 322 arranged at an upper end of the housing body 321, a second stop block 323 arranged at the upper end of the housing body 321 in symmetry with the first stop block 322, and first fixation blocks 324 arranged on two sides of the housing body 321.

The frame body 1 is internally provided with a first clamping recess 11 clamping the first stop block 322.

In the first example, the housing body 321 is provided with a second hole 3211 corresponding to the terminal 31, and the first fixation block 324 includes a first clamping block 3241 perpendicular to a plane where the first stop block 322 is located, and a second clamping block 3242 arranged in symmetry with a middle line of one side of the first clamping block 3241, the second clamping block 3242 being arranged corresponding to the terminal 31.

In the first example, one side, close to the first fixation block 324, of the terminal 31 is provided with a third stop block 311, the terminal 31 penetrates a second hole 3211 to be connected to the PIN needle 21, and the third stop block 311 is fixedly connected to a second clamping block 3242 in a clamping manner.

In the first example, an upper end of the first fixation block 324 and a front of the first fixation block 324 are provided with second stop blocks 323, and a second clamping recess 12 and a third clamping recess 13 which clamp the second stop blocks 323 are provided in the frame body.

A vertical section of the first stop block 322 is a right triangle. One side of the first stop block 322 is provided with an inclined plane, and one side, opposite the inclined plane, of the first stop block is a clamping surface perpendicular to a horizontal plane. The arrangement of the inclined plane facilitates easy and quick clamping between two objects. The arrangement of the clamping surface ensures clamping stability of the two objects. The inclined plane has an angle of 15-30 degrees.

Through the arrangement of the outlet body 3, fixing of the plastic housing 32 on the frame body 1 is implemented by clamping and fixing the first stop block 322 of the plastic housing 32 with the first clamping recess 11 of the frame body 1. Then, the terminal 31 is inserted into the plastic housing 32, and the second clamping block 3242 of the first fixation block 324 is clamped by the third stop block 311 of the terminal 31, one second clamping block 3242 is clamped by each terminal 31 accordingly, such that the plastic housing 32 sleeves the terminal 31. In addition, the second stop blocks 323 at the upper end of the first fixation block 324 and the front of the first fixation block 324 are clamped in the second clamping recess 12 and the third clamping recess 13, such that after the outlet body 3 is connected to the PIN body 2, the outlet body 3 is prevented from shaking on the frame body 1, the connection stability between the outlet body 3 and the frame body 1 is ensured, sealing-off is prevented, and reverse insertion is prevented.

Example 2

Figure 9:
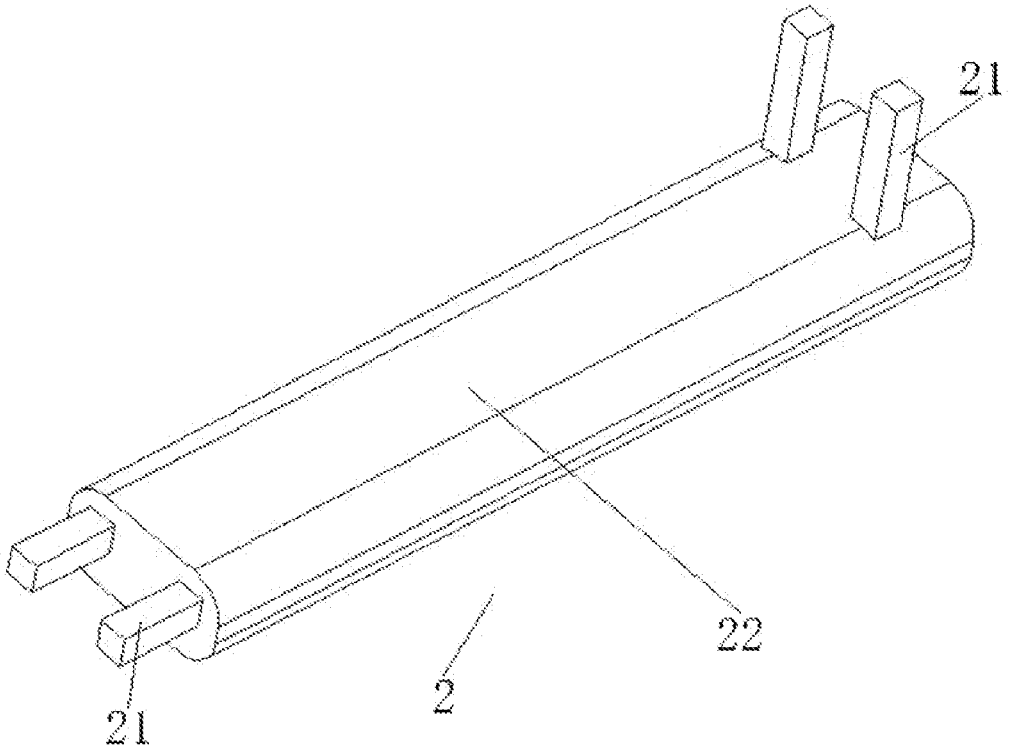
FIG. 9 is a schematic structural diagram of a PIN body according to a second example of the present invention.

As shown in FIG. 9, different from example 1, the number of PIN needles 21 is 2.

Example 3

Figure 10:
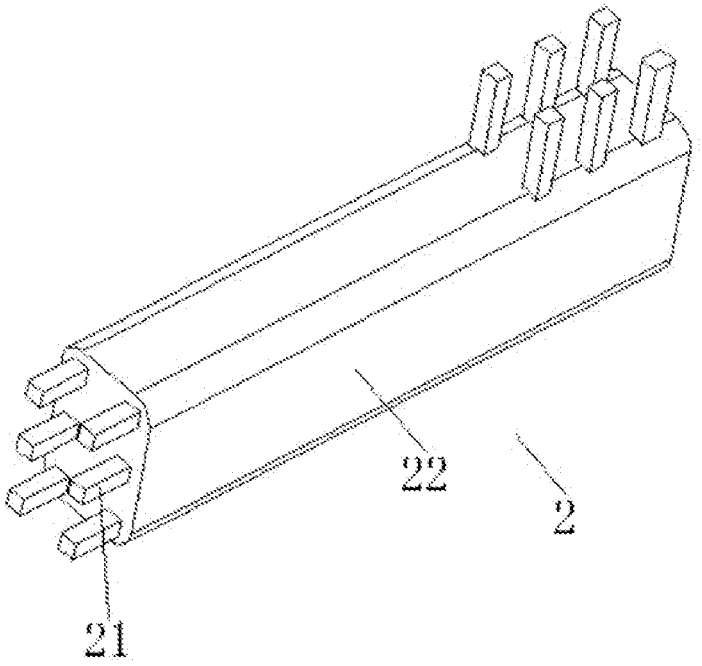
FIG. 10 is a schematic structural diagram of a PIN body according to a third example of the present invention.

As shown in FIG. 10, different from example 1, the number of PIN needles 21 is 6.

The present invention has the following beneficial effects: by designing the fan frame, the problem that flexible wires 33 are difficult to weld to a circuit board 4 is solved, thus facilitating automatic assembly on the circuit board 4, improving welding accuracy, effectively preventing the phenomenon of under-stress sealing-off, improving a welding success rate and effectively ensuring production quality. And, the wires are convenient to connect to a test fixture, thus avoiding testing by manually connecting the wires one by one, and achieving automatic testing, and simple, convenient and quick operation.

For those skilled in the art, it is apparent that the present invention is not limited to the details of the above exemplary examples, and the present invention can be implemented in other specific forms without departing from the spirit or basic features of the present invention. Therefore, no matter from which point of view, the examples should all be regarded as exemplary and non-limiting. The scope of the present invention is defined by the appended claims rather than the above description, and therefore it is intended that all changes which fall within the meaning and scope of equivalent elements of the claims are embraced in the present invention. Any reference numeral in the claims should not be construed as limiting the related claims.

Moreover, it shall be understood that although the description is described according to embodiments, not every embodiment merely includes an independent technical solution. The narrative manner of the description is merely for the sake of clarity. Those skilled in the art should take the description as a whole, and the technical solutions in each example can be appropriately combined to form other embodiments that can be understood by those skilled in the art. It should be noted that the technical features not described in detail in the present invention can be implemented by any prior art.

What is claimed is:

1. A fan frame, comprising a frame body, a PIN body embedded in the frame body, and an outlet body connected to one end of the PIN body; an accommodation cavity is provided in the frame body, and the PIN body is embedded in the accommodation cavity, and the other end of the PIN body is connected to a circuit board; and the PIN comprises PIN needles arranged in an array and a needle case sleeving the PIN needles.

2. The fan frame according to claim 1, wherein the number of the PIN needles is a multiple of 2.

3. The fan frame according to claim 1, wherein the PIN needle is a square PIN needle or a round PIN needle.

4. The fan frame according to claim 1, wherein the needle case is provided with first holes corresponding to the PIN needles.

5. The fan frame according to claim 1, wherein the outlet body comprises a terminal connected to the PIN needle, a plastic housing sleeving the terminal and embedded in the accommodation cavity, and a wire connected to the other end of the terminal.

6. The fan frame according to claim 5, wherein the plastic housing comprises a housing body, a first stop block arranged at an upper end of the housing body, and first fixation blocks arranged at two sides of the housing body, and the frame body is internally provided with a first clamping recess clamping the first stop block.

7. The fan frame according to claim 6, wherein the housing body is provided with a second hole corresponding to the terminal, and the first fixation block comprises a first clamping block perpendicular to a plane where the first stop block is located, and a second clamping block arranged symmetrically with respect to a middle line of one side of the first clamping block, the second clamping block being arranged corresponding to the terminal.

8. The fan frame according to claim 6, wherein one side, close to the first fixation block, of the terminal is provided with a third stop block, the terminal penetrates a second hole to be connected to the PIN needle, and the third stop block is fixedly connected to a second clamping block in a clamping manner.

9. The fan frame according to claim 6, wherein an upper end of the first fixation block and a front of the first fixation block are provided with second stop blocks, and second clamping recesses clamping the second stop blocks are provided in the frame body.

* * * * *